US007219767B1

(12) United States Patent
Steinbok

(10) Patent No.: US 7,219,767 B1
(45) Date of Patent: May 22, 2007

(54) SERVING UTENSIL ON RETRACTABLE TETHER

(76) Inventor: Harry Steinbok, 5855 Windsor Ct., Boca Raton, FL (US) 33496

( * ) Notice: Subject to any disclaimer, the term of this patent is extended or adjusted under 35 U.S.C. 154(b) by 0 days.

(21) Appl. No.: 10/755,442

(22) Filed: Jan. 13, 2004

(51) Int. Cl.
*E04H 3/04* (2006.01)

(52) U.S. Cl. ..... 186/38; 186/33; 186/44; 248/37.3; 248/37.6; 248/51; 248/52; 248/123.11; 248/328; 248/329; 248/309.1; 248/693

(58) Field of Classification Search ..... 248/37.3, 248/37.6, 51, 52, 123.11, 320, 328, 329, 693, 248/309.1; 119/770, 796, 791, 792, 794, 119/771; 24/115 R; 108/26; 99/337; 312/140.1, 312/114, 137; 126/277; 186/38, 33, 44; 30/150, 149, 147
See application file for complete search history.

(56) References Cited

U.S. PATENT DOCUMENTS

| | | | | |
|---|---|---|---|---|
| 2,308,771 | A * | 1/1943 | Mooney | 242/375 |
| 2,900,045 | A * | 8/1959 | Conklin et al. | 186/44 |
| 4,416,438 | A | 11/1983 | King | 248/102 |
| 4,997,157 | A | 3/1991 | Sweeny | 348/168 |
| 5,131,151 | A * | 7/1992 | Agase et al. | 30/327 |
| 5,230,117 | A | 7/1993 | Johnson et al. | 15/106 |
| 5,382,196 | A * | 1/1995 | Lodrick | 473/38 |
| 6,112,357 | A * | 9/2000 | Halloran | 15/106 |
| 6,129,398 | A | 10/2000 | Calhoun | 294/99.2 |
| 6,216,605 | B1 * | 4/2001 | Chapman | 108/26 |
| 6,318,302 | B1 * | 11/2001 | Bedient | 119/786 |
| 6,419,175 | B1 * | 7/2002 | Rankin, VI | 242/373 |
| 6,487,756 | B1 | 12/2002 | Vidal, Jr. | 24/3.1 |
| 6,499,899 | B2 | 12/2002 | Sawyer | 401/131 |
| 6,739,243 | B2 * | 5/2004 | Yagi | 99/352 |
| 2005/0103572 | A1 * | 5/2005 | Simon | 186/38 |

* cited by examiner

*Primary Examiner*—Carl D. Friedman
*Assistant Examiner*—Todd M. Epps
(74) *Attorney, Agent, or Firm*—Kenneth E. Merklen

(57) ABSTRACT

A serving utensil, used for serving food on a salad bar, is attached to a retractable tether device. The retractable tether device is coupled to the under surface of a sneeze shield extending over the food on a salad bar, effectively elevating the retractable tether device and the serving utensil above and/or over food on the salad bar.

13 Claims, 6 Drawing Sheets

SERVING UTENSIL ON RETRACTABLE TETHER

BACKGROUND OF THE INVENTION

1. Field of the Invention

The present invention relates to apparatus for providing sanitary practices, in the preparation and the handling of food for human consumption. In particular, the invention is an apparatus providing sanitary storage, retention and use of serving utensils used at salad bars, buffet counters, and the like.

2. Prior Art

When food is served in a salad bar or in a buffet counter style, it is customary to provide one or more serving utensils, such as a serving spoon or salad tongs, for example, to use when transferring food from the service dish or pan of the salad bar or the buffet counter to the plate of the person helping himself from the food service. It is the usual practice to provide a serving utensil for each dish of food set out. When a serving utensil is used only on the food for which it is intended, contamination of the serving utensil by other foods is avoided. It is difficult, however, to keep the particular serving utensil at the intended food, since persons helping themselves to food from the service bar or counter, often tend to hold on to the serving utensil and use the same serving utensil for several foods in the service. This can result in contamination of the serving utensil by other foods and in contamination of food by other food. Using the same serving utensil on a plurality of different foods may rearrange the location of the serving utensils, causing several serving utensils to be left at one dish of food, for example, while other dishes of foods are left without serving utensils.

People tend to be impatient. If a serving utensil is not readily in appearance and/or readily available, persons taking food from dishes on the salad bar or buffet service tend to improvise, using other utensils and, more often than not, use their fingers to transfer food from the service dish, pan or container holding the food, to their plate. A person may drop a serving utensil on the floor and retrieve it, only to place the retrieved serving utensil back in the dish, pan or container holding the food. Though such practice is discouraged and frowned upon, it does occur. There is a need for providing serving utensils at a salad bar and/or buffet counter type food service which are highly visible, readily and easily available, usable within a limited, predetermined space, secure from falling on the floor when dropped, and easily removably for replacement.

Food served in a salad bar and/or in a buffet counter service, for example, is normally partially covered with a sneeze shield. A sneeze shield is a transparent sheet of material, such as clear glass or clear plastic, for example, spaced over the food, which protects the food from the forced exhale of a sneeze by a person adjacent the food served on the salad bar or buffet, for example. There is, however, a space between the food and the sneeze shield so that the person intent in taking food from the salad bar or buffet, may do so without interference from the sneeze shield. One aspect of the present invention makes use of the sneeze shield, used for protecting food served in salad bar and/or buffet counter style, in a manner and for a purpose not heretofore intended.

SUMMARY OF THE INVENTION

The present invention, in a preferred embodiment, provides an automatic retractable tether device suspended above the food containers and/or food service in a salad bar or a buffet style food service, with a serving utensil, such as a serving spoon or salad tongs, for example, coupled to the free end of the retractable tether of the retractable tether device. A retractable tether device is well known. One popular use of a retractable tether device is a retractable tape measure. Retractable tether devices are taught in:

| | |
|---|---|
| U.S. Pat. No. 2,308,771 | issued to Mooney 1943; |
| U.S. Pat. No. 5,382,196 | issued to Lodrick 1995; |
| U.S. Pat. No. 6,112,357 | issued to Halloran 2000; |
| U.S. Pat. No. 6,419,175 B1 | issued to Rankin VI 2002. |

Mooney, in his U.S. Pat. No. 2,308,771 patent, teaches attaching a bar of soap to the free end of a retractable cord or tether. Lodrick, in his U.S. Pat. No. 5,382,196 patent teaches attaching a chalk holder for a billiard/pool cue to the free end of a retractable flexible line. Halloran, in his U.S. Pat. No. 6,112,357 patent, teaches attaching a brush member to the free end of a tether and, Rankin, VI, in his U.S. Pat. No. 6,419,175 B1 patent teaches a retractor device with a swivel attachment component extending from the retractor housing.

An embodiment of the invention provides for securing or coupling the housing component of a retractable tether device to the under surface of a sneeze shield covering food containers and/or food served in a salad bar or buffet counter style food service, with a serving utensil connected to the free end of the tether of a retractable tether device. The tether may be in the form of a cord, line, cable or chain, for example, with one end connected to a spring biased reel and the other end a free end. Retraction pressure on the extended tether may be a continuous pressure or may be a clutch release retraction pressure.

The retractable tether device may be coupled or secured to the sneeze shield by a substantially permanent coupling such as an hook or an eye on a threaded shaft screwed into the sneeze shield or on a threaded shaft passed through a hole in the sneeze shield and held with a threaded nut and washer arrangement. Alternately, the retractable tether device may be coupled or secured to the sneeze shield by a non-permanent coupling, such as a suction cup or a VELCRO brand fastener or a tape with an adhesive on both sides of the tape, for example.

When the retractable tether device is secured to the under side of the sneeze shield of a salad bar or buffet style food service and a serving utensil is coupled to the free end of the tether, the serving utensil is essentially elevated above the food containers and/or food on the salad bar and is highly visible and easily accessible. The tether, which is extendable from the retractor housing is of limited length and the length of the tether defines the range of use of the serving utensil among the pans or dishes set out on the food service. The tethered serving utensil, when released by a person using the same, is retracted to the retractor housing and held, above the food container and/or food, ready for use by others using the food service. Dropping the service utensil is eliminated. Contamination of food by using the same serving utensil for several different foods is avoided. Contamination of food is also prevented by preventing the handle of the serving utensil, which has been held by hands of different persons at the food service bar, from coming in contact with the food.

In another embodiment of the invention a shaft is provided with a clamp means at one end, for coupling the shaft to the rim of a dish or pan or other container used for containing food on the salad bar or food service bar. A housing is provided at the other or extreme end thereof, for mounting and/or retaining a retractable tether device. The retractable tether device is mounted in and/or retained in a housing adjacent the extreme of the shaft. A line or tether is attached, at one end to a rotatable spool in the retractable tether device and has a free end extending from the spool housing. An opening or port in the shaft housing permits the free end of the tether to extend out of the housing at the end of the shaft. A serving utensil is coupled to the free end of the tether. The retractable tether device may be similar to the retractable tether device taught by Lodrick in his U.S. Pat. No. 5,382,196, or a modification thereof, for example. The shaft, between the end having a clamp means and the end having a housing for the retractable tether device, is sufficiently long and serves to elevate the retractable tether device and the serving utensil attached to the free end of the tether of the retractable tether device, to a level above the food in the pan or dish to which the shaft is coupled, so that the serving utensil coupled to the free end of the retractable tether does not come in contact with the food in the dish or pan to which the shaft is coupled, when the tether is in retracted position. Means may be provided, on the food service bar, to connect or couple the end of the shaft having the clamp means, to the service bar adjacent the dish or pan retained in a port in the cover of the salad bar or food service bar.

In another embodiment of the invention, a stand or holder is provided for elevating and securing the retractable tether device at a level above of the food in the pans and/or dishes of a salad bar or buffet style food service. The stand or holder may include a base plate with a shaft extending, at normal, from the plate to a distal end, where a clamp is located. Alternatively, the origin end of the shaft may include a clamp means for clamping the shaft to the side of a pan, eliminating the base plate. Where the stand includes a base plate, the base plate rests on the inside bottom of the pan or dish holding the food, holding the shaft in a vertical orientation. Where the stand includes a clamp means, the clamp fits over the rim of a pan, for example, holding the shaft in a vertical orientation, with respect to the pan. The retractable tether device is connected to the distal end of the vertically disposed shaft, at an elevation sufficient to elevate the serving utensil attached to the free end of the tether, above the food in the dish or pan supporting the shaft.

OBJECTS OF THE INVENTION

It is an object of the present invention to readily provide a serving utensil at a salad bar or buffet style food service.

It is another object of the invention to provide a serving utensil at a salad bar or food service bar which is readily available for use by persons serving themselves from the salad bar or food service bar, which keeps the handle of the serving utensil from making contact with the food in the pan or dish supported by the salad bar, for avoiding contamination of the food, as the handle of the serving utensil is handled and/or held by the hand of many different persons who serve themselves food from the pans or dishes of the salad bar or food service bar.

Another object of the invention is to provide an openly visible, usable serving utensil for use at a salad bar or buffet style food service, the range of use of which is selectively limited.

A further object is to provide a readily available serving utensil for selectively serving one's self food from a pan or dish on a salad bar or buffet style food service, where the serving utensil is secure from falling to the floor, when released.

A still further object of the invention is to provide a serving utensil for selecting a food from a salad bar or buffet style food service which has a limited range of use with respect to person using the utensil and prevents transportation of the serving utensil from food to food on the food service.

These and other objects will become apparent when reading the accompanying description of the invention with reference to the drawings below.

DETAILED DESCRIPTION OF THE INVENTION

Figure 1:
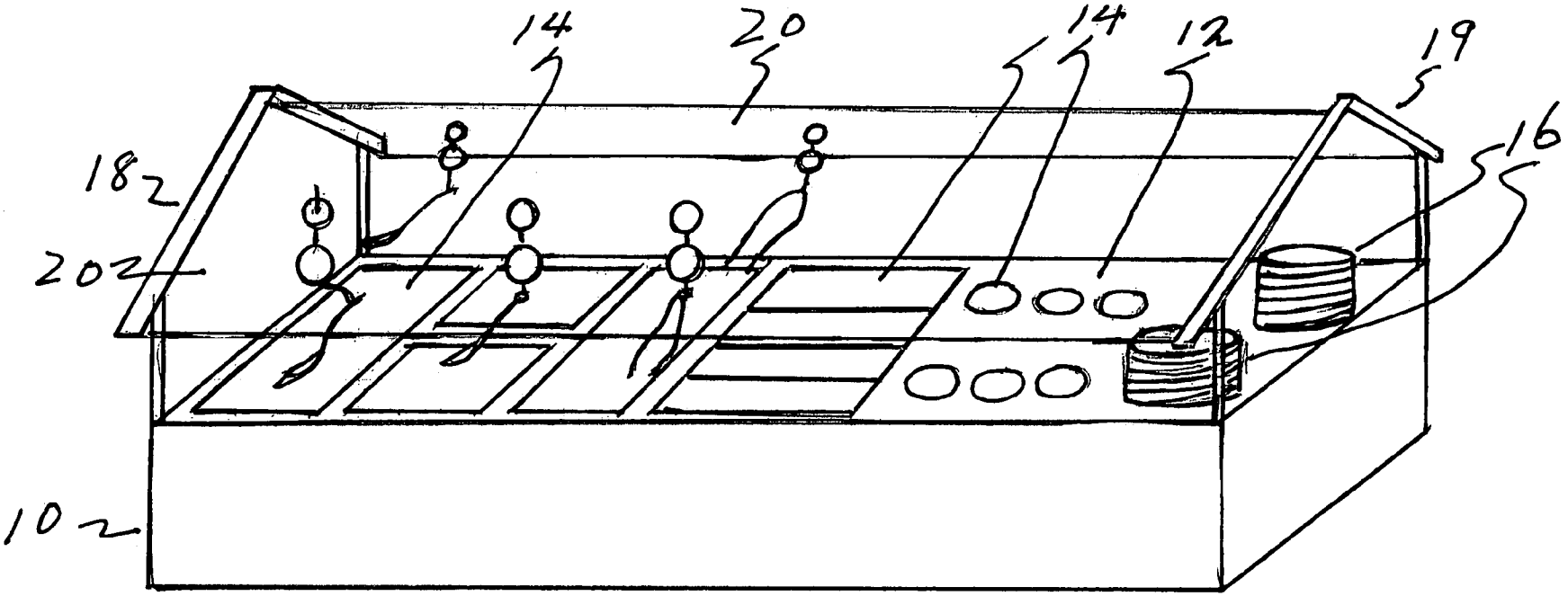
FIG. 1 represents a salad bar with sneeze shield and the present invention used in association with the salad bar.

FIG. 1 represents a salad bar, which may be a free standing, substantially permanent fixture or a portable salad bar service. The structure includes a base or housing 10 which may support heating and/or cooling elements, not shown. The base 10 has a cover or deck 12 with holes or ports 14 of various size and shape that support pans, dishes and/or containers of corresponding shape, not shown. The pans, dishes and/or containers are removable and hold food. When the salad bar is filled or loaded, pans and/or dishes with food are set in the holes or ports in the deck of the salad bar. Stacks of plates 16 are usually positioned at one end of the salad bar, usually at the "start" end of the salad bar. Pitched end supports 18–19 cooperate to hold a transparent sneeze shield 20. Coupled to and extending from the inside or under surface of the sneeze shield are one or more retractable tether devices. Units 11 and 12, for example, are each attached to the under side of the sneeze shield 20. Unit 13 is coupled to the edge of a pan or dish. Attached to the free end of the tether of each retractable tether device is a serving utensil.

Attaching or coupling the retractable tether device to the under surface of the sneeze shield elevates the retractable tether device over the pan or dishes set in the cover or deck of the salad bar, and thus above and/or over the food contained in the pan or dish. The orientation of a retractable tether device is over an opening in the cover 12 of the salad bar, that supports a dish or pan of food. The length of the tether of the retractable tether device defines the range of use of the serving utensil attached to the free end of the tether. The location at which the retractable tether device is attached to the inside surface of the sneeze shield is such that the position of the serving utensil is above the food in the dish or pan set in a corresponding hole or opening in the cover or deck of the housing of the salad bar. A major consideration is to keep the handle of the serving utensil from coming in contact with the food in the pan with which the invention is associated, since persons using the salad bar take hold of the handle of the serving utensil with their hand, which potentially contaminates the handle of the serving utensil. If a contaminated handle of a serving utensil comes in contact with food, the food will be contaminated.

The transparency of the sneeze shield permits visual access to the serving utensil suspended from the under surface of the shield. While in a retracted or at rest position, the serving utensil is highly visible to persons adjacent to and/or using the salad bar. By selectively positioning the coupling of the retractable tether device coupled with a serving utensil, to a location centrally over the pan in the deck, the serving utensil is made available for use in removing food from the particular pan on the salad bar and the handle of the serving utensil does not contact the food in the pan. The length of the tether defines the range of use of the serving utensil, with respect to the pan in the lay-out of holes for pans in the deck of the salad bar. Limiting the range of use of the serving utensil restricts the use of the serving utensil to only the food desired and avoids contamination of food caused when using the same serving utensil on two different foods. When a person is finished using the serving utensil and releases the utensil, the retractable characteristics of the retractable tether device returns the serving utensil to its retracted or rest position above and/or over the food. Several retractable tether devices are represented in FIG. 1. The serving utensil used with any retractable tether device may be a serving spoon, a pair of serving tongs or other serving utensil.

Figure 2:
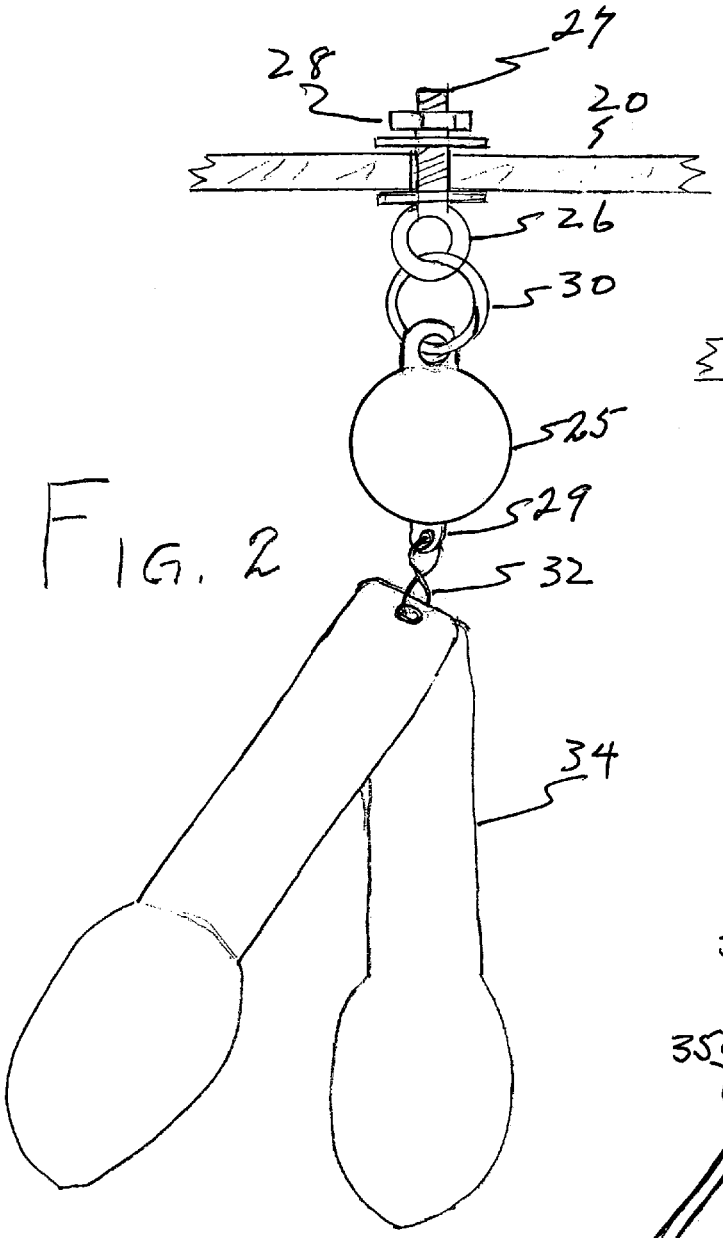
FIG. 2 represents one embodiment of the invention where the invention is secured to a sneeze shield by a substantially permanent coupling.

FIG. 2 represents one embodiment of one aspect of the invention where a retractable tether device 25 is attached to an eye hook 26 by a split ring or snap ring 30. Extending from the eye hook 26 is a threaded shaft 27 which is inserted in a hole in the sneeze shield 20 and secured in place by a washer and threaded nut 28. Alternatively, a screw or other fixed coupling may be used to secure the retractable tether device to the sneeze shield. The retractable tether has a free end at 29, to which a serving utensil is coupled by an "S" hook 32. The serving utensil is represented by a pair of tongs 34. The embodiment of the invention shown in FIG. 2 is represented in FIG. 1 as unit 11, for example.

Figure 3:
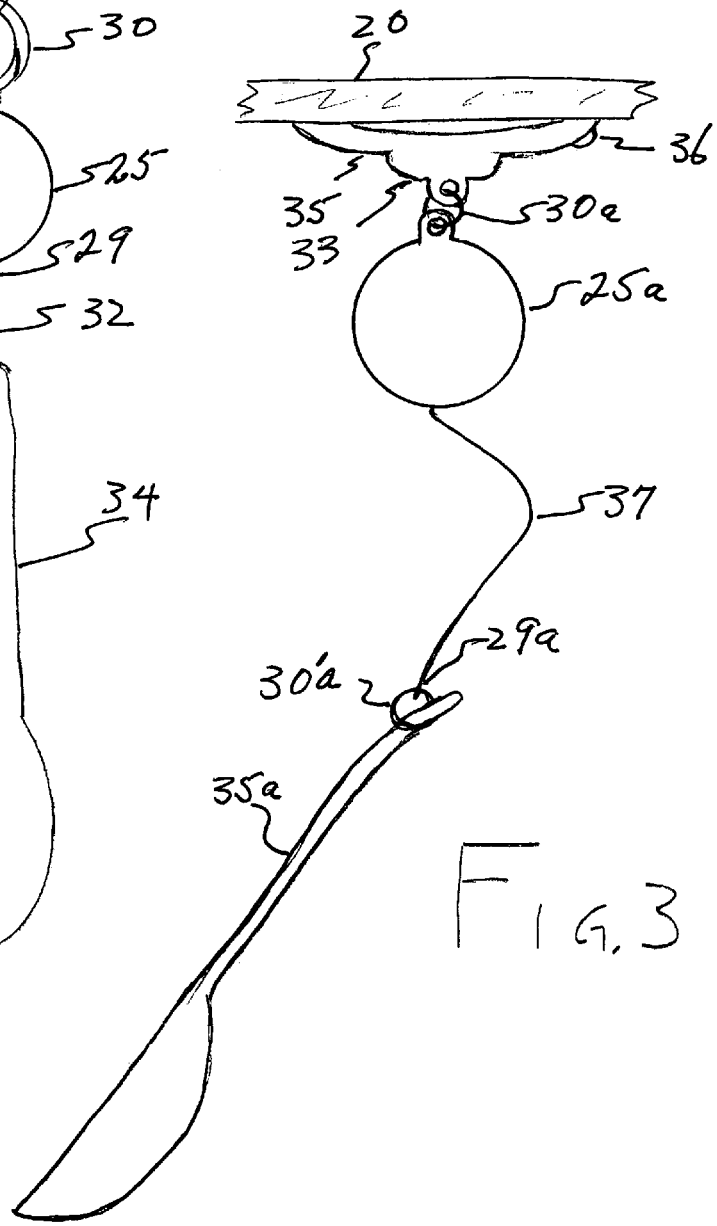
FIG. 3 represents another embodiment of the invention represented in FIG. 2 where the invention is secured to a sneeze shield by a non-permanent coupling.

FIG. 3 represents an alternate embodiment of the invention represented in FIG. 2, where a retractable tether device 25*a* is coupled, by a split ring or snap ring 30*a*, to the eye in the crown 33 of a suction cup 35. The body of the suction cup is secured to the under surface of the sneeze shield 20. The free end 29*a* of the tether 37 is coupled to a serving utensil, represented by a serving spoon 35*a*, by a snap ring or split ring 30'*a*. The body of the suction cup includes a nipple 36, which may be grasped and pulled to break the suction holding the body of the suction cup to the surface of the sneeze shield 20. The embodiment of the invention shown in FIG. 3 is represented in FIG. 1 as unit 12, for example.

Figure 4:
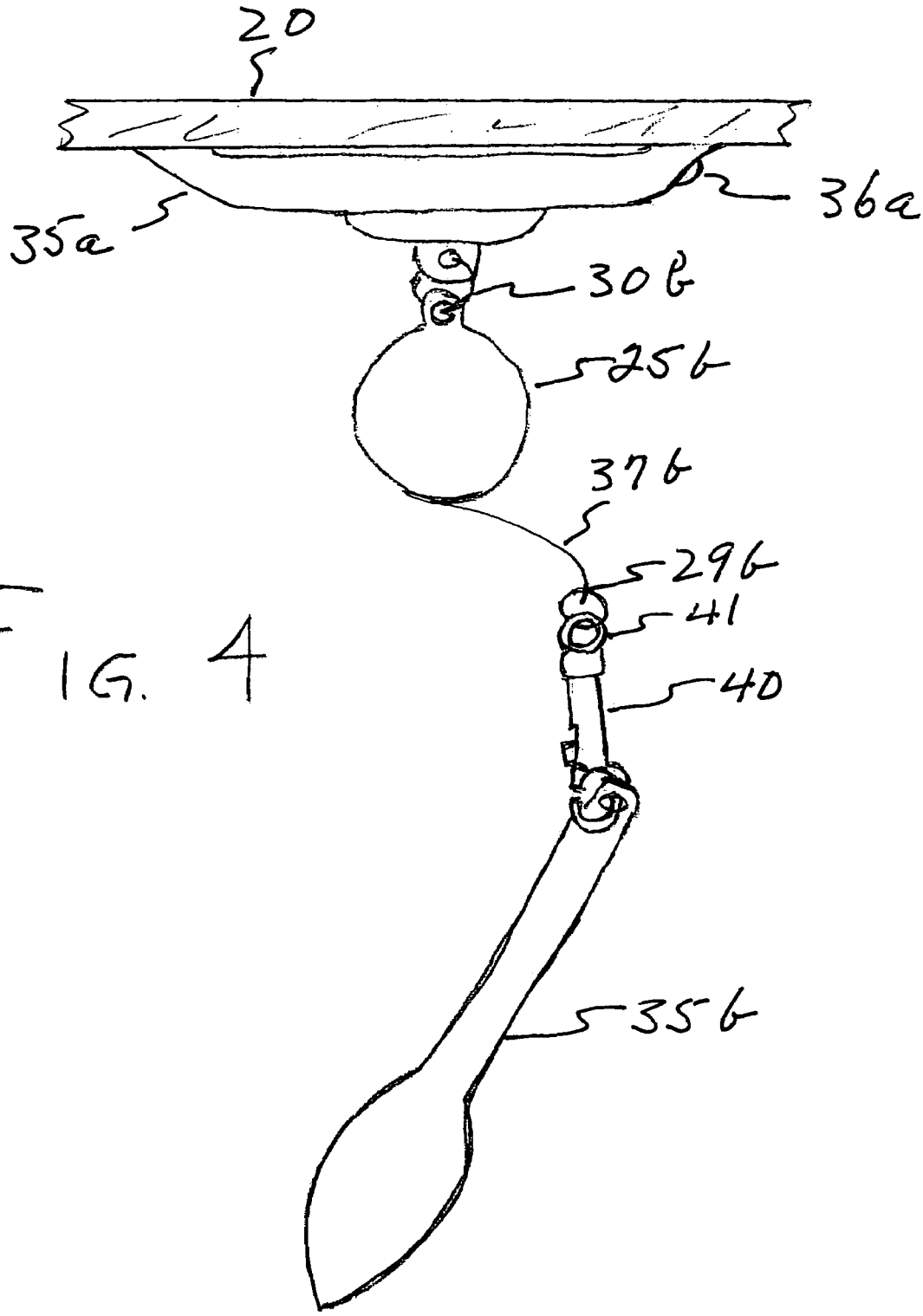
FIG. 4 represents the invention represented in FIG. 3 with a snap swivel deposed between the free end of the tether and the serving utensil.

FIG. 4 represents a further embodiment of the invention represented in FIGS. 2 and 3 where a retractable tether device 25*b*, with tether 37*b*, is coupled to the eye in the crown of a suction cup 35*a* with a split ring or snap ring 30*b*. The body of the suction cup 35*a* is secured to the under surface of the sneeze shield 20. A snap swivel 40, at its fixed end 41, is coupled to the free end 29*b* of the tether 37*b*. The snap swivel represents a coupling means between the free end 29*b* of the tether and the serving utensil 35*b* that may be opened for removal and replacement of the serving utensil. In FIG. 2, the means for elevating the retractable tether device/serving utensil combination over and/or above food on the salad or food service bar, is represented in substantially permanent form. The means for elevating the retractable tether device/serving utensil combination represented in FIGS. 3 and 4 is represented in removable, temporary form.

FIGS. 5, 6, 7 and 8 each represent other embodiments of the invention, where an alternate means for elevating the retractable tether device/serving utensil combination above the pans and/or dishes in the deck of the salad bar or above the pans and/or dishes in the buffet style serving, is represented.

Figure 5:
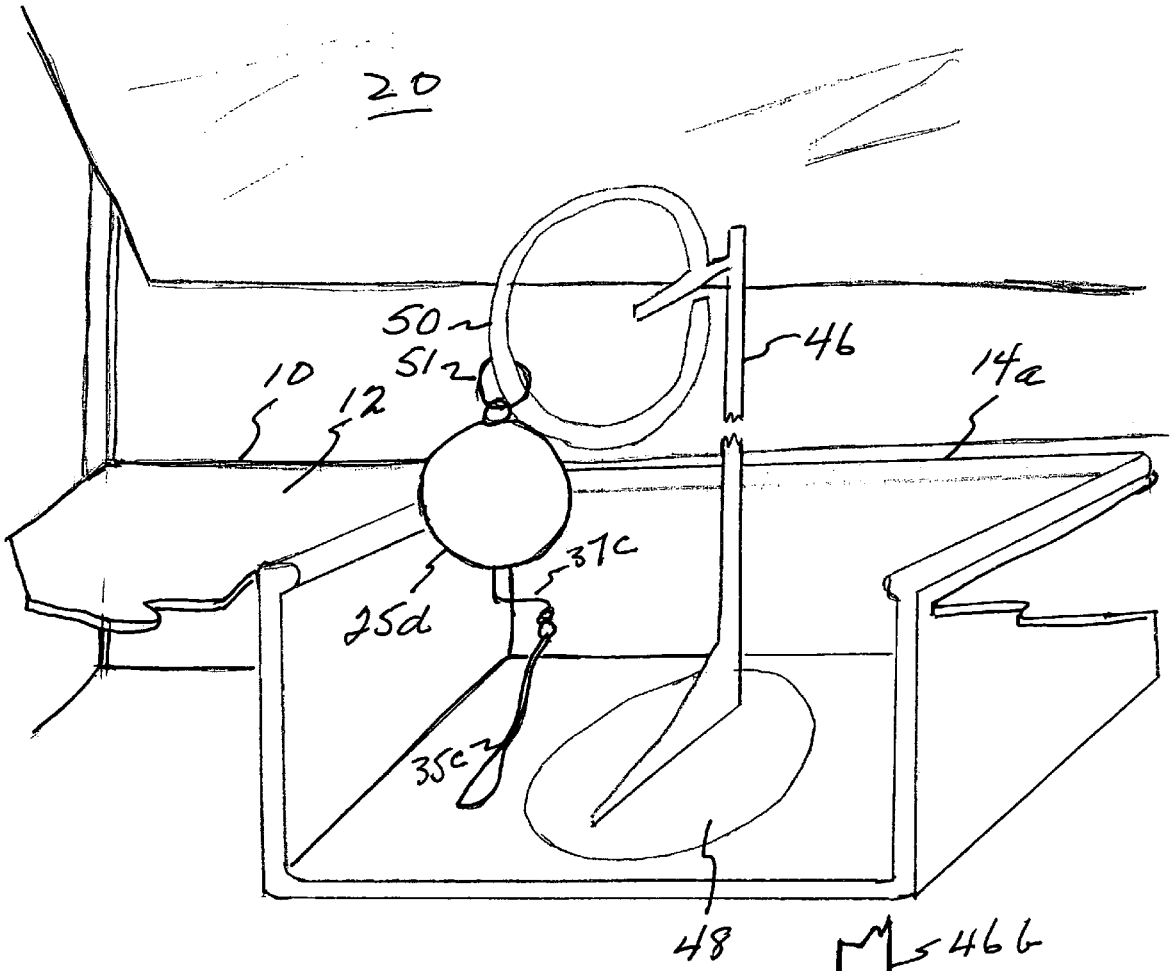
FIG. 5 represents a further embodiment of the invention with a stand/shaft support for elevating the retractable tether device.

In FIG. 5, a pan 14*a* is represented, supported in a port in the deck 12 of the housing 10 of a salad bar, under a sneeze shield 20. A holder, defined by a shaft 46 extending at normal from a base plate 48 stands on the inside bottom of the pan 14*a*. The shaft, at its distal end has an open coupling 50, for receiving a coupling, such as split ring 51, which is coupled to the eye on a retractable tether device 25*d*. The length of shaft 46 is sufficient to elevate the coupled retractable tether device/serving utensil combination for holding the serving utensil 35*c* above the level of the food placed in the pan 14*a*. The base plate 48 and shaft 46 are fabricated preferably from a stainless steel or other material that may be placed in the bottom of the pan, covered with food and cooked with food, in a sanitary manner.

Figure 5A:
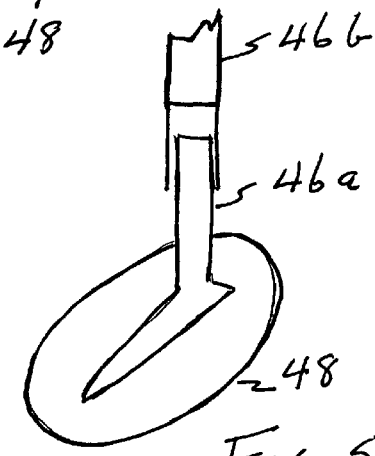
FIG. 5*a* represents an alternative embodiment of the shaft in FIGS. 5 and 6.
Figure 6:
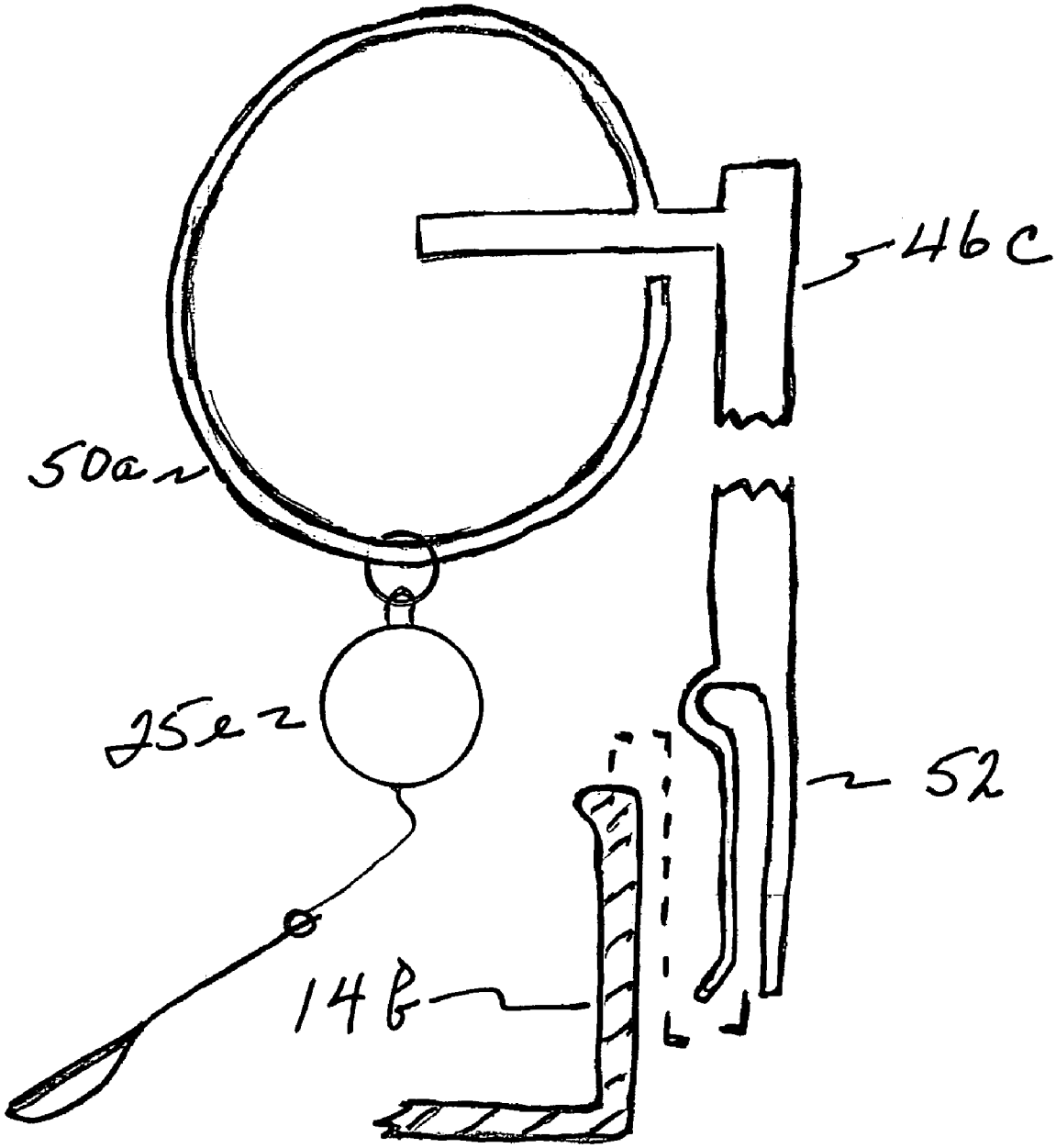
FIG. 6 represents an alternate embodiment of the invention represented in FIG. 5 where the base plate, supporting the shaft is replaced by a clamp means.

FIG. 5*a* represents that the shaft 46 of FIG. 5 and shaft 46*c* of FIG. 6 may each be a two piece fitted shaft, such as 46*a* and 46*b*. This will permit the stem 46*a* of the shaft to be made sufficiently short so that the base plate 48 and stem 46*a* may be placed in the pan prior to cooking and cooked with the food, if desired. The fitted female section 46*b* of the fitting, may be attached to the male section 46*a* when the pan is removed from cooking the food.

FIG. 6 represents an alternate structure for securing the shaft 46*c* to the pan 14*b*. The base or lower end of the shaft 46*c* defines a clamp 52, which fits over the rim and side or end of the pan 14*b*. The broken line represents how the clamp 52 fits over the rim and clamps on the edge of the pan 14*b*. A wing nut 54 represents an adjustable locking clamp which, when securing the shaft 52 to the side of a pan 41*b* keeps the shaft aligned vertically, with respect to the bottom of the pan. The open coupling 50*a*, at the distal end of the shaft 46*c*, is sufficiently high to elevate the coupled retractable tether device 25*e* so that the serving utensil, when the tether is retracted, is held above the level of the food in the pan 14*b*.

Figure 7:
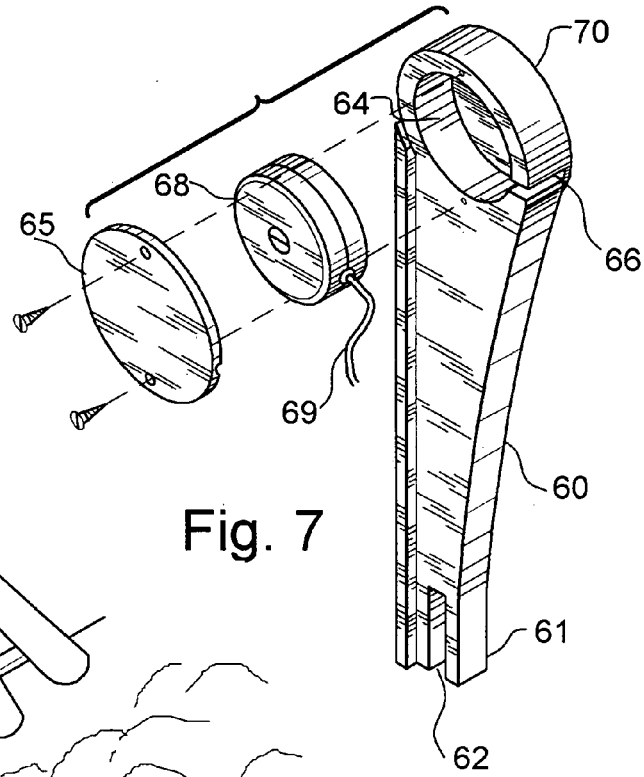
FIG. 7 represents a still further embodiment of the invention, in exploded view, along line 7—7 in FIG. 8.
Figure 8:
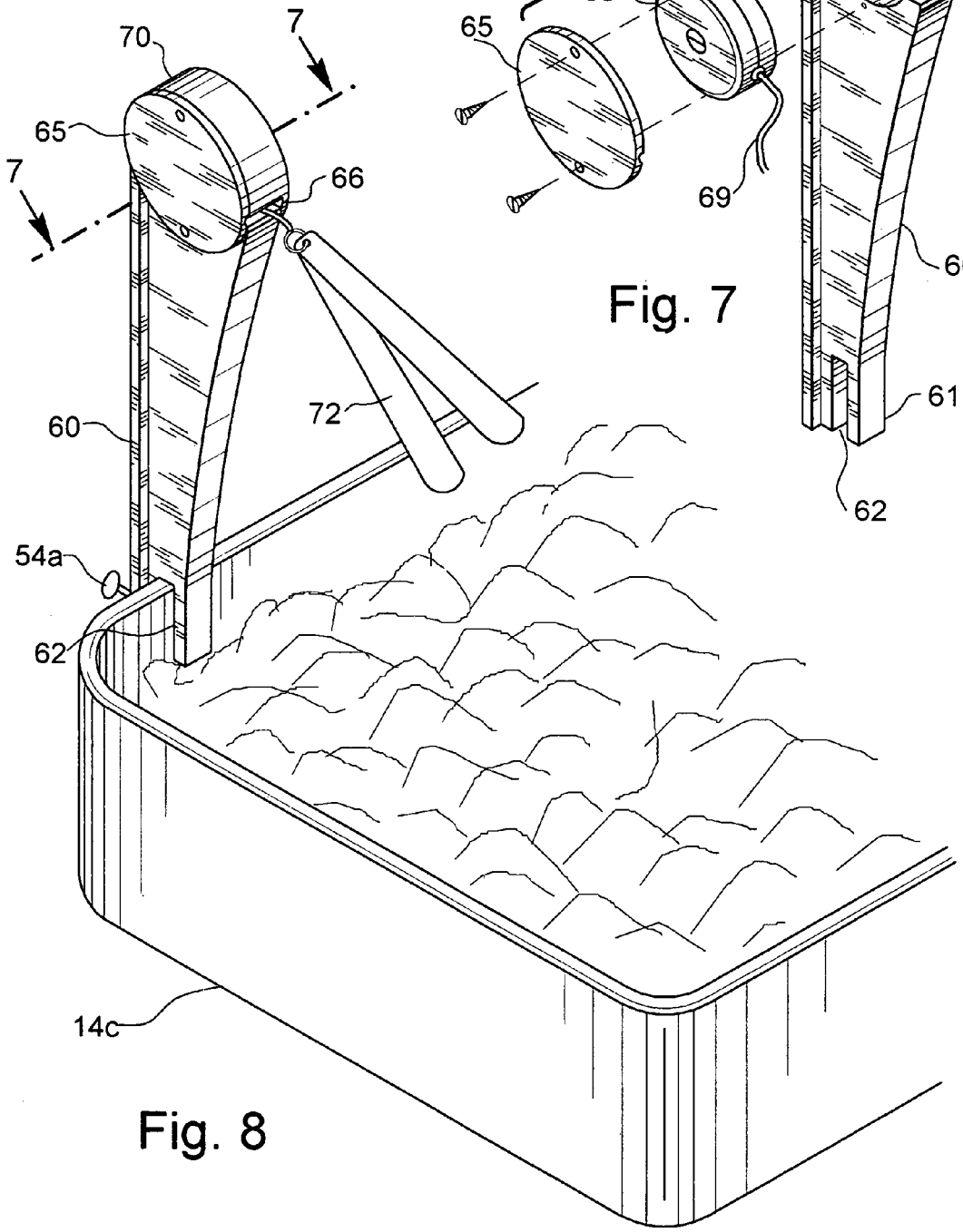
FIG. 8 represents the invention represented in FIG. 7, in use, clamped to the rim of a pan containing food.

FIGS. 7 and 8 represent a preferred embodiment of the invention. In FIG. 7, a shaft 60 defines the means for elevating a retractable tether device above and/or over food in a pan in a salad and/or food service bar. At one end 61 a split 62 is provided for fitting over the rim of a pan. This may be similar to the split 55 on the shaft 52 in FIG. 6. A locking means may also be provided. At the other end of the shaft 60 a housing 64 and housing cover 65 are provided, with an opening at 66 when the housing cover is in place, as represented in FIG. 8. A retractable tether device 68, is positioned in the housing 64 and secured therein by the housing cover 65. The retractable tether device 68 is oriented in the housing so that the free end of the tether extends out the opening 66. FIG. 8 represents the invention represented in FIG. 7 in use on a pan 41*c* of food. The split 62 at the end of the shaft 60 is fitted over the rim of the pan 14*c* and locked in place by an adjustable locking wing nut or thumb screw 54*a*. The free end of the retractable tether passes through the opening 66 in the head end 70 of the shaft. The housing cover 65 secures the retractable tether device in the housing. A serving utensil, represented as a pair of tongs 72 is coupled to the free end of the tether.

In the foregoing description of the invention, referenced to the drawings, certain terms have been used for conciseness, clarity and comprehension. However, no unnecessary limitations are to be implied from or because of the terms used, beyond the requirements of the prior art, because such terms are used for descriptive purposes and are intended to be broadly construed. Furthermore, the description and illustrations of the invention are by way of example, and the scope of the invention is not limited to the exact details shown, represented or described.

Having now described a preferred embodiment and several alternate embodiments of the invention, in terms of features, discoveries and principles, along with certain alternative construction and suggested changes, other changes that may become apparent to those skilled in the art may be made, without departing from the scope of the invention defined in the appended claims.

What is claimed is:

1. An extendible serving utensil for serving food at a salad bar, said extendible serving utensil comprising:

a) a retractable tether housing member;

b) a salad bar and a sneeze shield, positioned above and extending over said salad bar;

c) a fixed coupling means defined by an eye with a shaft extending therefrom, said shaft being passed through a hole in said sneeze shield for coupling said fixed coupling means to said sneeze shield, said retractable tether housing member coupled to said eye for elevating said retractable tether housing member above said salad bar;

d) a tether member connected to said retractable tether housing member at one end thereof for retracting said tether member into said retractable tether housing member, said tether member having a free end; and e) a food serving utensil coupled to said free end of said tether member.

2. An extendible food serving utensil for serving food at a salad bar, said extendible food serving utensil comprising:

a) a retractable, extendible tether housing member;

b) a salad bar and a container for supporting food, supported on said salad bar;

c) a shaft, with a first end and a distal end, coupled to said container at said first end and extending at normal from said container, said distal end having a connector means for receiving said retractable, extendible tether housing member and for retaining said retractable, extendible tether housing member above food supported in said container;

d) a tether member connected to said retractable extendible tether housing member at an end thereof for retracting said tether member into said retractable extendible tether housing member, said tether member having a free end; and e) a food serving utensil coupled to said free end of said tether member.

3. An extendible food serving utensil as in claim 2 and in which said shaft is a two piece element with a male connector and a female connector.

4. A retractable serving utensil system for partaking food from containers on a salad bar; said retractable serving utensil system comprising;

a) a retractable tether member having an extendible, retractable tether, said tether having a first end and a free end;

b) a salad bar for supporting a container thereon and a sneeze shield over said salad bar and means for coupling said retractable tether member above said container on said salad bar wherein said means for coupling said retractable tether member to said sneeze shield is an eye hook with a threaded shaft and said threaded shaft extends through a hole in said sneeze shield and is held in place by a threaded nut; and c) a serving utensil member and a means for coupling said serving utensil member to said free end of said extendible, retractable tether.

5. A retractable serving utensil system as in claim 4 wherein said serving utensil member is a spoon.

6. A retractable serving utensil system as in claim 4 wherein said serving utensil member is a pair of tongs for serving food.

7. A retractable food serving utensil system for partaking food from containers on a salad bar, said retractable serving utensil system comprising:

a) a retractable tether member having an extendible, retractable tether, said tether having a first end and a free end;

b) a salad bar and a sneeze shield, positioned above and extending over said salad bar; a means for elevating said retractable tether member above a container supported on a salad bar wherein said means for elevating includes a shaft having a first end and a distal end and said first end of said shaft includes a means for securing said shaft to said container supported on said salad bar and said distal end includes a means for securing said retractable tether member to said shaft; and c) a food serving utensil and a means for coupling said food serving utensil to said free end of said extendible, retractable tether.

8. A retractable food serving utensil system as in claim 7 wherein said serving utensil is a spoon.

9. A retractable food serving utensil system as in claim 7 wherein said serving utensil is a pair of tongs for serving food.

10. A retractable food serving utensil system for partaking food from containers on a salad bar, said retractable food serving utensil system comprising:

a) a retractable tether member having an extendible, retractable tether, said tether having a first end and a free end;

b) a salad bar and a sneeze shield, positioned above and extending over said salad bar; a means for elevating said retractable tether member above a container supported on a salad bar wherein said means for elevating includes a shaft having a first end and a distal end and said first end of said shaft includes a means for securing said shaft to said container supported on said salad bar and said distal end includes a housing for receiving and securing said retractable tether member to said shaft; and c) a food serving utensil and a means for coupling said food serving utensil to said free end of said extendible, retractable tether.

11. A retractable food serving utensil system as in claim 10 and in which said housing for receiving and securing said retractable tether means includes a hole for permitting said extendible, retractable tether to extend out of said housing and said housing further includes a cover means for securing said retractable tether means in said housing.

12. A retractable food serving utensil system as in claim 10 wherein said serving utensil is a spoon.

13. A retractable food serving utensil system as in claim 10 wherein said food serving utensil is a pair of tongs for serving food.

* * * * *